United States Patent [19]

McDevitt

[11] Patent Number: 4,530,438

[45] Date of Patent: Jul. 23, 1985

[54] TAMPER INDICATING PACKAGES

[75] Inventor: Thomas M. McDevitt, Toledo, Ohio

[73] Assignee: Owens-Illinois, Inc., Toledo, Ohio

[21] Appl. No.: 607,053

[22] Filed: May 4, 1985

[51] Int. Cl.[3] ..... B65D 41/34

[52] U.S. Cl. ..... 215/252

[58] Field of Search ..... 215/252

[56] References Cited

U.S. PATENT DOCUMENTS

| | | | |
|---|---|---|---|
| 2,162,712 | 6/1939 | Hamberger | 215/252 |
| 4,153,174 | 5/1979 | Keeler | 215/252 |
| 4,346,811 | 8/1982 | Hilaire | 215/252 |

*Primary Examiner*—Donald F. Norton

*Attorney, Agent, or Firm*—John R. Nelson

[57] ABSTRACT

A tamper indicating package comprising a container having a neck with external threads formed thereon, and a plastic closure comprising a top panel and an integral depending annular skirt. The skirt has integral internal threads thereon complementary to the threads on the neck of the container. The container having an annular bead positioned axially below the threads. The skirt has a tamper indicating ring at the lower end thereof connected to the remainder of the skirt along a weakened line below the threads when the closure is on the container. The band has a radially inwardly extending lug on the inside surface thereof such that when the closure is threaded on the container, the lug falls into the notch and engages the underside of the annular bead and when the closure is rotated to unthread the closure, the lug is cammed downwardly under the bead and at least a portion of the band is severed from the remainder of the closure.

10 Claims, 4 Drawing Figures

TAMPER INDICATING PACKAGES

This invention relates to tamper indicating packages.

BACKGROUND AND SUMMARY OF THE INVENTION

In the application of closures to containers, it has become known to provide some indication that the closure has been removed in order to indicate to a user that the contents may have been tampered with. In one type of tamper indicating package, a plastic closure is applied to the container and a tamper indicating band is connected by weakened lines to the closure. The band engages a bead on the container such that when the closure is removed, the band is broken along the weakened line from the closure leaving the band on the container.

In one type of closure, the closure is made of plastic and the band is formed after the closure has been molded by a scoring along the periphery of the skirt of the closure. In such a closure, it is necessary to permit the closure to be stored for a long period such as 12 hours before the scoring is applied. This necessitates a delay in the production of the closures between the molding and the scoring operations.

In another type of closure, the band is connected to the skirt of the closure by a plurality of bridges. These bridges are molded in the closure necessitating a more complex mold. In addition the bridges must be such that they will not break upon application but will break upon removal. Accordingly, the prior art structures have disadvantages.

Among the objectives of the present invention are to provide a tamper indicating package wherein breakage of the bridge portions during application of the closure is eliminated; wherein positive means are provided for breaking the bridge portions on removal of the closure; wherein the criticality of sizing the bridge portions or weakened lines is eliminated; which simplifies the construction of the tooling for the closures; which reduces the amount of raw material in the closure and container; which permits the tamper indicating band to meet test requirements for the force required to sever the bond; which eliminates wing reversing operation and which allows the tolerances of scoring or formation of the bridge portions to be broadened and less critical.

In accordance with the invention, the tamper indicating package comprises a container having a neck with external threads formed thereon and a plastic closure comprising a top panel and an integral depending annular skirt. The skirt has integral internal threads thereon complementary to the threads on the neck of the container. The container having an annular bead positioned axially below the threads. The skirt has a ring at the lower end thereof connected to the remainder of the skirt along a weakened line below the threads when the closure is on the container. The bead has a notch in the periphery thereof. The band has a radially inwardly extending lug on the inside surface thereof such that when the closure is threaded on the container, the lug falls into the notch and engages the underside of the annular bead and when the closure is rotated to unthread the closure, the lug is cammed downwardly under the bead and at least a portion of the band is severed from the remainder of the closure.

DESCRIPTION

Figure 1:
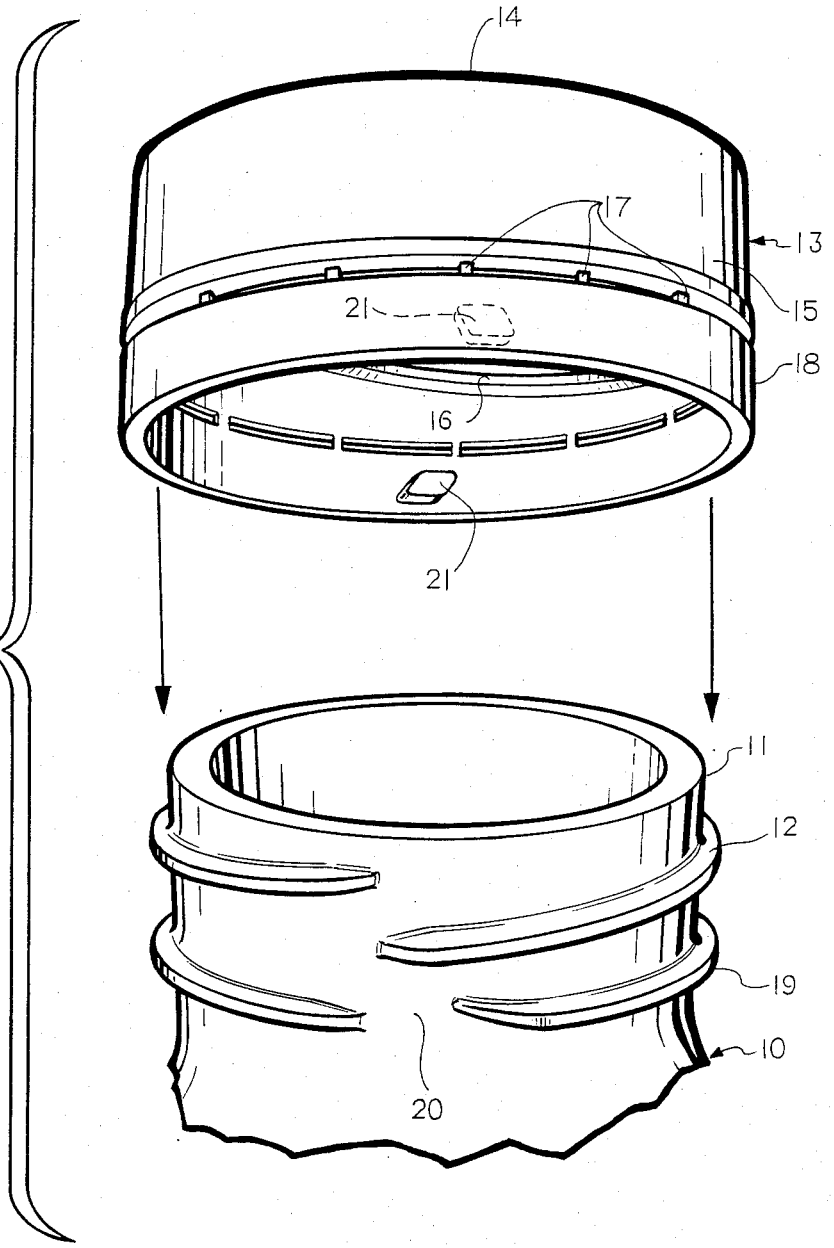
FIG. 1 is a fragmentary exploded perspective view of a tamper indicating package embodying the invention.

Referring to FIGS. 1–4, the package embodying the invention comprises a container 10 having a neck 11 with external threads 12 thereon and a plastic closure 13 including a top wall 14 and a peripheral skirt 15 having internal threads 16 engaging the threads 12 on the container. The top wall 14 includes an annular liner or rib adapted to engage the upper end of the container in a manner well known in the art. The container 10 may be made of glass or plastic. The closure 13 is preferably made of plastic such as high density polyethylene.

In accordance with the invention, the lower annular portion of the skirt 15 is connected to the remainder of the skirt by a plurality of circumferentially spaced integral bridge portions 17 to define a pilfer or tamper indicating band or ring 18. In addition, the container 10 is formed with an annular bead 19 which has voids or notches 20 in the periphery thereof.

Figure 2:
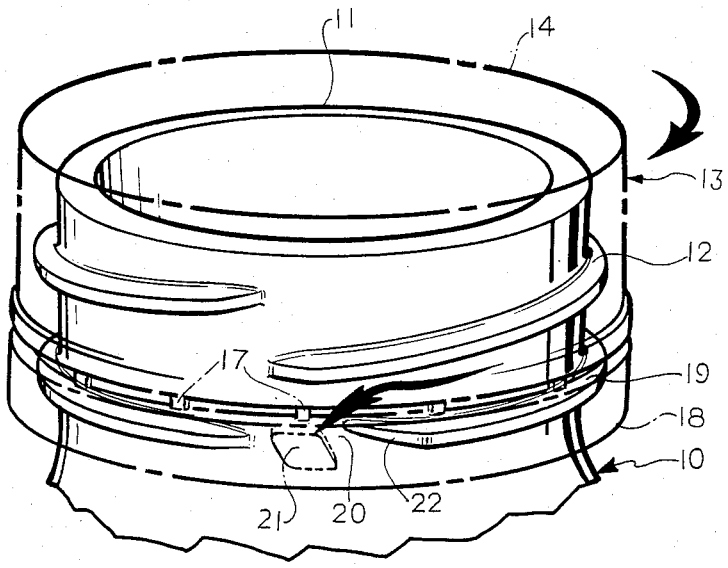
FIGS. 2 and 3 are fragmentary diagrammatic perspective views showing the operation of the package.
Figure 3:
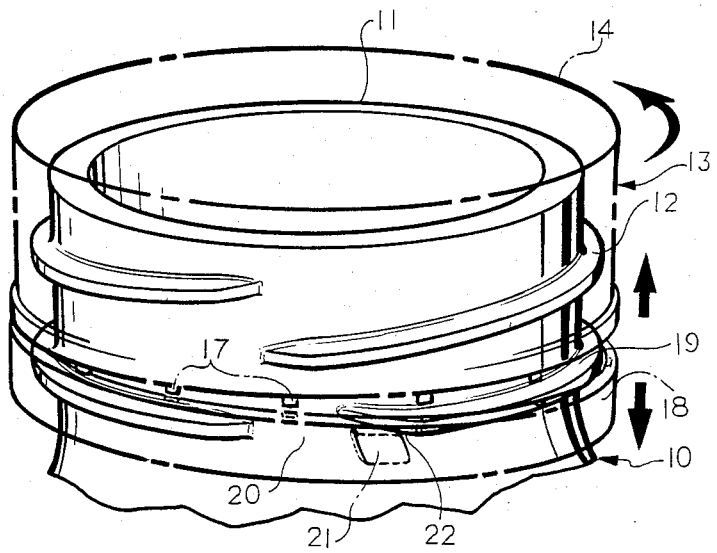
Figure 4:
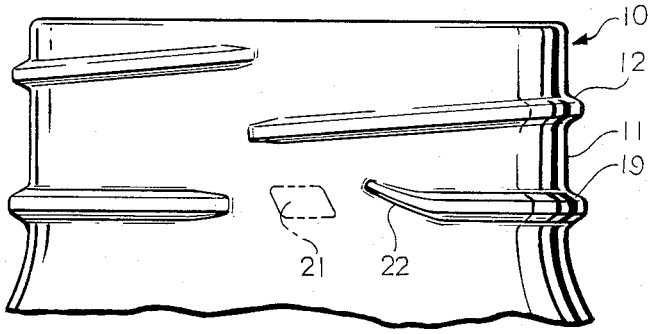
FIG. 4 is a fragmentary elevational view of the container.

The pilfer ring has a plurality of circumferentially spaced radially inwardly extending lugs 21 which are positioned so that they fall into the notches 20 when the closure is fully threaded onto the container (FIGS. 2, 4). When it is desired to remove the closure 13, the lugs 21 engage the annular bead 19 on the container and pass under the bead 19 so that continuous unthreading movement of the closure 13 places a downward force on the lugs 21 and, in turn, the pilfer ring 18 causing the bridge portions to sever (FIG. 3).

As shown in FIG. 4, the lug 21 is preferably in the shape of a parallelogram that is inclined downwardly and in the direction of rotation of the closure during unthreading. The end of the bead 19 which is engaged by the lug 21 is formed with a generally complementary downwardly inclined surface 22 that extends in the direction of unthreading of the closure 13 so that the lugs 21 are cammed downwardly beneath the annular bead 19 and engage the underside of the bead 19 as the closure 13 is unthreaded.

I claim:

1. A tamper indicating package comprising a container having a neck with external threads formed thereon, a plastic closure comprising a top panel and an integral depending annular skirt, said skirt having integral internal threads thereon complementary to the threads on the neck of the container, said container having an annular bead positioned axially below the threads, said skirt having a ring at the lower end thereof connected to the remainder of the skirt along a weakened line below the threads when the closure is on the container, said bead having a notch in the periphery thereof, said ring having a radially inwardly extending lug on the inside surface thereof constructed and arranged such that when the closure is fully threaded on the container, the lug falls into the notch and when the closure is rotated to unthread the closure, the lug engages the bead and passes under the bead and is cammed downwardly under the bead and at least a portion of the band is severed from the remainder of the closure.

2. The tamper indicating package set forth in claim 1 wherein said lug has a surface inclined circumferentially downwardly with respect to the top of the closure and in the direction in which the closure is rotated to unthread the closure.

3. The tamper indicating package set forth in claim 2 wherein said annular bead has a complementary surface inclined downwardly and in the direction in which the closure is rotated to unthread the closure for engagement with the surface of the lug.

4. The tamper indicating package set forth in claim 1 wherein said lug is inclined circumferentially downwardly with respect to the top of the closure and in the direction in which the closure is rotated to unthread the closure.

5. The tamper indicating package set forth in claim 4 wherein said annular bead has a complementary surface inclined downwardly and in the direction in which the closure is rotated to unthread the closure.

6. The tamper indicating package set forth in claim 2 wherein said ring includes a plurality of said lugs and said bead includes a plurality of said notches into which the lugs fall when the closure is fully threaded on the container.

7. A plastic tamper indicating closure for a container having a neck with external threads thereon and an annular bead positioned axially below the threads and at least one notch therein, said closure comprising a top panel and an integral depending annular skirt, said skirt having integral internal threads thereon adapted to be complementary to the threads on the neck of the container, said skirt having a ring at the lower end thereof connected to the remainder of the skirt along a weakened line below the threads when the closure is on the container, said ring having a radially inwardly extending lug on the inside surface thereof constructed and arranged such that when the closure is fully threaded on a container, the lug falls into a notch of an annular bead on the container and when the closure is rotated to unthread the closure, the lug engages the bead and passes under the bead and is cammed downwardly under the bead and at least a portion of the band is severed from the remainder of the closure.

8. The tamper indicating closure set forth in claim 7 wherein said lug has a complementary surface inclined circumferentially downwardly with respect to the top of the closure and in the direction in which the closure is rotated to unthread the closure.

9. The tamper indicating closure set forth in claim 7 wherein said lug comprises a trapezoid and includes a surface inclined circumferentially downwardly with respect to the top of the closure and in the direction in which the closure is rotated to unthread the closure.

10. The tamper indicating closure set forth in claim 8 wherein said ring has a plurality of radially inwardly extending lugs which are adapted to fall into notches of an annular bead on the container when the closure is fully threaded on the container.

* * * * *